US005120612A

United States Patent [19]

Ashok

[11] Patent Number: 5,120,612

[45] Date of Patent: Jun. 9, 1992

[54] INCORPORATION OF CERAMIC PARTICLES INTO A COPPER BASE MATRIX TO FORM A COMPOSITE MATERIAL

[75] Inventor: Sankaranarayanan Ashok, Bethany, Conn.

[73] Assignee: Olin Corporation, Cheshire, Conn.

[21] Appl. No.: 576,889

[22] Filed: Sep. 4, 1990

[51] Int. Cl.[5] ..... B22D 23/00

[52] U.S. Cl. ..... 428/614; 420/492

[58] Field of Search ..... 428/614; 420/492

[56] References Cited

U.S. PATENT DOCUMENTS

| | | | |
|---|---|---|---|
| Re. 31,767 | 12/1984 | Brooks | 164/46 |
| 3,522,039 | 7/1970 | McLain | 420/477 |
| 3,663,311 | 5/1972 | Chin et al. | 148/11.5 R |
| 3,775,156 | 11/1973 | Singer | 427/177 |
| 4,420,441 | 12/1983 | Singer | 264/7 |
| 4,738,712 | 4/1988 | Singer | 164/46 |
| 4,804,034 | 2/1989 | Leatham et al. | 164/46 |
| 4,961,457 | 10/1990 | Watson et al. | 164/46 |

FOREIGN PATENT DOCUMENTS

| | | | |
|---|---|---|---|
| 0225080 | 7/1987 | European Pat. Off. . | |
| 0295008 | 12/1988 | European Pat. Off. . | |
| 119660 | 11/1984 | Japan . | |
| 0152644 | 8/1985 | Japan | 148/432 |
| 177160 | 1/1986 | Japan . | |
| 214164 | 3/1986 | Japan . | |
| 8905870 | 6/1989 | PCT Int'l Appl. . | |
| 2172900 | 10/1986 | United Kingdom . | |

OTHER PUBLICATIONS

Singh et al., "Evolution of Microstructure in Spray Cast Cu-Zr", Modern Developments in Powder Metallurgy, vol. 19, 489-502, 1988.

Evans, R. W., A. G. Leatham and R. G. Brooks, "The Osprey Preform Process Powder Metallurgy", vol. 28, No. 1, pp. 13-20, 1985.

*Primary Examiner*—Upendra Roy

*Attorney, Agent, or Firm*—Bruce E. Burdick; H. Samuel Kieser

[57] ABSTRACT

A method of casting a copper based composite which includes a second phase ceramic particles. A copper or copper based alloy containing a eutectic reactive element is spray cast with the ceramic particles being injected into the spray cast stream of material prior to its being deposited onto the moving substrate. The eutectic reactive element diffuses into the ceramic particles and provides a good bond between the copper based matrix and the second phase ceramic particles. The ceramic particles may be selected from the group consisting of oxides, borides, nitrides, carbides and mixtures thereof. The eutectic reactive materials may include zirconium, chromium, titanium, aluminum and magnesium.

11 Claims, 1 Drawing Sheet

INCORPORATION OF CERAMIC PARTICLES INTO A COPPER BASE MATRIX TO FORM A COMPOSITE MATERIAL

BACKGROUND OF THE INVENTION

1. Field of the Invention

This invention relates generally to a method of making a composite copper or copper alloy material having incorporated therein second phase particles. More particularly, this invention relates to the method of making a composite copper alloy comprising having a copper or copper base alloy matrix having a second phase of ceramic particles dispersed therein.

2. Background Information

Copper and copper base alloy materials are useful in many applications. For some applications, it is desirable to modify the properties of copper or the copper base alloy material by the incorporation of ceramic particles therein to improve such properties as strength, wear resistance, hardness, modulus elasticity and thermal characteristics.

However, for such ceramic particles to be effective in improving the properties of the alloy, the interface between the matrix and the particles must be strong. That is, the ceramic particles must bond with the matrix material. In the case of copper, it has been found that under normal casting conditions, the ceramic particles do not bond to the copper matrix and accordingly, the resulting alloy does not realize improved properties.

One relatively new method of casting metal is the spray casting process which generally comprises the steps of atomizing a fine stream of molten metal, depositing the particles onto a collector where the hot particles solidify to form a preform and then working or directly machining the preform to generate the final shape and/or properties required.

One form of such a spray casting process is generally known as the OSPREY process and is more fully disclosed in U.S. Pat. Nos. RE 31,767 and 4,804,034 as well as United Kingdom Patent No. 2,172,900. Further details about the process are contained in the publication entitled "The Osprey Preform Process" by R. W. Evans, et al, Powder Metallurgy, Vol. 28, No. 1 (1985).

In the OSPREY process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to form a sequence of movements within the spray, so that the desired preform shape can be generated. The preform can then be further processed, normally by hot working, to form a semi-finished or finished product.

The OSPREY process has also been developed for producing strip or plate or spray-coated strip or plate as disclosed in U.S. Pat. No. 3,775,156 and European Patent Application No. 225,080. For producing these products, a substrate or collector such as a flat substrate or an endless belt is moved continuously through the spray to receive a deposit of uniform thickness across its width.

SUMMARY OF THE INVENTION

It has been found that in accordance with this invention, the spray casting process may be used in casting copper or copper base alloy composites containing ceramic material. The second phase solid ceramic particles may be introduced into a copper or copper base alloy material during spray casting when the copper or copper base alloy material contains a eutectic reactive element which is capable of diffusing into the ceramic particles. The copper base material containing the reactive element is spray cast with the solid ceramic particles being introduced into the spray of molten metal before it is deposited on the substrate.

BRIEF DESCRIPTION OF THE DRAWINGS

The present invention will be better understood by reference to the following detailed description and to the accompanying drawing in which.

DETAILED DESCRIPTION

Figure 1:
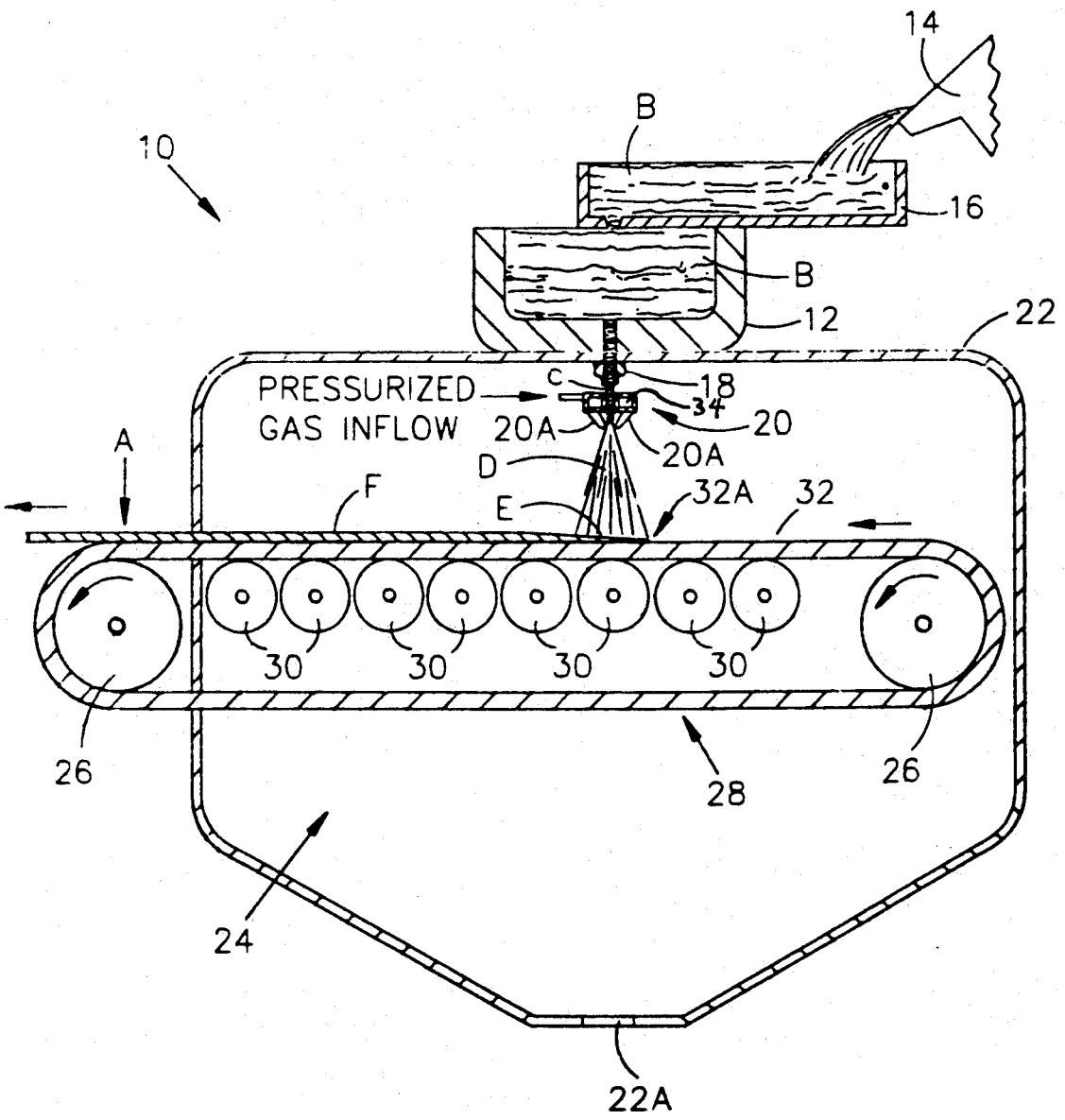
FIG. 1 is a schematic elevational view partially in section of a spray-deposition apparatus suitable for producing a composite material in accordance with the present invention.

In accordance with the present invention, a composite material or a copper or copper base alloy matrix with a second phase of solid ceramic particles may be produced by first microalloying the copper or copper base alloy matrix with a eutectic reactive element which is capable of diffusion into the ceramic particles.

Generally, the ceramic materials which may form the second phase particles in the copper or copper base alloy matrix according to the present invention may include oxides, borides, nitrides, carbides and mixtures thereof which are difficult to bond with the copper or copper base alloy during conventional casting processes. Specific materials which have particular utility for use in this invention include silicon carbide, aluminum oxide, titanium nitride, titanium oxide, silicon nitride, titanium boride, zirconium boride and tungsten carbide.

These particles are introduced as particulate solids into the spray of the molten copper based material containing a eutectic reactive element. The eutectic reactive element should be one that is capable of diffusing into the ceramic particles and also alloying with the copper or copper base material Such eutectic reactive elements may include materials such as zirconium, chromium and titanium. Aluminum and magnesium may also be used but are not thought to be as effective as the previously mentioned materials.

The reactive element or elements may be alloyed with a copper based component by any conventional alloying process such as by adding them to the copper melt before the melt is atomized and spray cast. The amount of such reactive element should be sufficient to diffuse into the ceramic material to effect a good bond between the ceramic material and the copper based matrix. The amount of such material may be in the range of from about 0.01 to about 5.0 weight percent and preferably in the range of about 0.1 to about 1.0 weight percent.

The copper based material containing the reactive element is spray cast onto a moving substrate upon which it solidifies to form a cast product. The solid ceramic particles are introduced by either by injecting them into the gas stream used to atomize the copper based melt or directly into the spray.

FIG. 1 discloses a spray deposition apparatus 10 which is used to produce a continuous strip of the composite material A.

The spray deposition apparatus 10 employs a tundish 12 in which a metal alloy having a desired composition B is held in molten form. The tundish 12 receives the molten alloy B from a tiltable melt furnace 14, via a transfer launder 16. The tundish 12 further has a bottom nozzle 18 through which the molten alloy B issues in a continuous stream C. A gas atomizer 20 is positioned below the tundish bottom nozzle 18 within a spray chamber 22 of the apparatus 10.

The atomizer 20 is supplied with a gas under pressure from any suitable source. The gas serves to atomize the molten metal alloy and also supplies a protective atmosphere to prevent oxidation of the atomized droplets. A most preferred gas is nitrogen. The nitrogen should have a low concentration of oxygen to avoid the formation of undesirable oxides. An oxygen concentration of under about 100 ppm and preferably less than about 10 ppm may be used. The atomizer 20 surrounds the molten metal stream C and has a plurality of jets 20A from which the gas exits to impinge on the stream C so as to convert the stream into a spray D comprising a plurality of atomized molten droplets. The droplets are broadcast downwardly from the atomizer 20 in the form of a divergent conical pattern. If desired, more than one atomizer 20 may be used. The atomizer(s) 20 may be moved in a desired pattern for a more uniform distribution of the molten metal particles.

A continuous substrate system 24 as employed by the apparatus 10 extends into the spray chamber 22 in generally horizontal fashion and spaced in relation to the gas atomizer 20. The substrate system 24 includes a drive means comprising a pair of spaced rolls 26, and endless substrate 28 in the form of a flexible belt entrained about and extending between the spaced rolls 26 and a series of rollers 30 which underlie and support an upper run 32 of the endless substrate 28. An area 32A of the substrate upper run 32 directly underlies the divergent pattern of spray D. The area 32A receives a deposit E of the atomized metal particles to form the metal strip product A.

The ceramic materials may be introduced in the apparatus 10 by feeding them into the plenum chamber 34 of the atomizer 20 where they will mix with the gas and exit through the jets 20A whereupon they mix with the spray D. Alternatively, they could be fed directly into the stream C before it enters the atomizer 20 or fed into the spray D as it exits from the atomizer 20.

By way of an example, silicon carbide particles were injected into the plenum chamber of an atomizer being used to spray cast copper and a copper alloy containing 0.2 percent zirconium. By analysis with a scanning electron microscope, it was determined that in the copper-zirconium with silicon carbide, the zirconium had diffused into the silicon carbide particles. When such a casting was tensile tested, the silicon carbide particles were observed to fracture indicating that the interface strength was greater than the particle strength. However, in the case of copper alone plus silicon carbide particles, when such was tensile tested, the interface failed indicating that the interface was weaker than the particles. Thus, it is concluded that by microalloying the copper with the reactive element, the interface strength between the silicon carbide particles and the copper base matrix was improved.

Although the invention has been described above in connection with a spray casting process used to cast strips or thin slabs of metal, the invention may also be used with the spray casting of other shaped products or preforms.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A method of casting a copper based composite containing a ceramic material comprising atomizing a molten stream of copper or copper based alloy containing a eutectic reactive element capable of diffusing into ceramic particles, introducing solid ceramic particles into said atomized stream, and depositing said stream onto a moving substrate to solidify said deposit to form a copper based alloy containing a second phase of ceramic particles.

2. The method of claim 1 wherein said eutectic reacting material is selected from the group consisting of zirconium, chromium, titanium, aluminum, magnesium and mixtures thereof.

3. The method of claim 2 wherein said eutectic reacting material is selected from the group consisting of zirconium, chromium, titanium and mixtures thereof.

4. The method of claim 2 wherein said ceramic material is selected from the group consisting of oxides, borides, nitrides, carbides and mixtures thereof.

5. The method of claim 2 wherein said eutectic material is present in said copper or copper based alloy in the amount of from about 0.01 to about 5.0 weight percent.

6. The method of claim 2 wherein said eutectic material is present in said copper or copper based alloy in the amount of from about 0.01 to about 1.0 weight percent.

7. The method of claim 4 wherein said ceramic material is selected from the group consisting of titanium oxide, titanium nitride, silicon carbide and aluminum oxide.

8. A spray cast copper based composite comprising a copper or copper based alloy containing a eutectic reactive element and ceramic particles, said ceramic particles having said reactive element diffused therein and forming a second phase with said copper or copper based alloy as a matrix and being bonded to said copper or copper based alloy.

9. The composite of claim 8 wherein said eutectic reactive element is selected from the group consisting of zirconium, chromium, titanium, aluminum, magnesium and mixtures thereof.

10. The composite of claim 8 wherein the ceramic material is selected from the group consisting of oxides, borides, nitrides, carbides and mixtures thereof.

11. The composite of claim 9 wherein said eutectic reactive element is selected from the group consisting of zirconium, chromium, titanium and mixtures thereof.

* * * * *